US006196674B1

(12) United States Patent
Takemoto

(10) Patent No.: US 6,196,674 B1
(45) Date of Patent: Mar. 6, 2001

(54) INK JET RECORDING METHOD USING TWO LIQUIDS

(75) Inventor: Kiyohikio Takemoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/051,096

(22) PCT Filed: Aug. 1, 1997

(86) PCT No.: PCT/JP97/02683

§ 371 Date: Aug. 17, 1998

§ 102(e) Date: Aug. 17, 1998

(87) PCT Pub. No.: WO98/05504

PCT Pub. Date: Feb. 12, 1998

(30) Foreign Application Priority Data

Aug. 1, 1996 (JP) ..... 8-203853

(51) Int. Cl.[7] ..... B41J 2/01
(52) U.S. Cl. ..... 347/103
(58) Field of Search ..... 347/101, 103

(56) References Cited

U.S. PATENT DOCUMENTS 4,246,839 * 1/1981 Willbanks ..... 347/103 X
5,006,862 * 4/1991 Adamic ..... 347/101
5,635,969 * 6/1997 Allen ..... 347/101 X
5,790,160 * 8/1998 Reeves et al. ..... 347/103
5,796,422 * 8/1998 Hanson et al. ..... 347/103
5,805,191 * 9/1998 Jones et al. ..... 347/103
5,841,456 * 11/1998 Takei et al. ..... 347/103

FOREIGN PATENT DOCUMENTS 0583168 2/1994 (EP) .
0606490 7/1994 (EP) .
63-299970 12/1988 (JP) .
64-85766 3/1989 (JP) .
392351 4/1991 (JP) .
3240557 10/1991 (JP) .
820720 1/1996 (JP) .

* cited by examiner

*Primary Examiner*—Fred L. Braun
(74) *Attorney, Agent, or Firm*—Ladas and Parry

(57) ABSTRACT

An ink jet recording method wherein two liquids, a first liquid and an ink composition are used. The first liquid includes a reactant capable of breaking dispersion of a colorant and the like in an ink composition to agglomerate the colorant component. According to this ink jet recording method, wherein two liquids are printed, the first liquid is once deposited onto an intermediate transfer medium and then transferred onto a recording medium. The ink composition is printed onto the recording medium with the first liquid transferred thereon. This can yield a good image. An apparatus for conducting printing in accordance with the method including an intermediate transfer medium on a drum; an ink jet recording head for depositing the first liquid onto the transfer medium; a drive for rotating the drum and an ink jet recording head for depositing the ink composition on the recording medium.

11 Claims, 1 Drawing Sheet

INK JET RECORDING METHOD USING TWO LIQUIDS

BACKGROUND OF THE INVENTION

1. Field of the Invention

The present invention relates to an ink jet recording method wherein a first liquid and an ink composition are deposited onto a recording medium to conduct printing, and a recording apparatus for use in the ink jet recording method.

2. Background Art

An ink jet recording method is a printing method wherein droplets of an ink composition are ejected and deposited onto a recording medium such as paper. This method can realize an image having high resolution and high quality at a high speed with a relatively inexpensive apparatus. In general, the ink composition used in the ink jet recording contains water as a main component and, added thereto, a colorant and a wetting agent such as glycerin added for prevention of clogging and other purposes.

On the other hand, a new ink jet recording method has been recently proposed which comprises applying a polyvalent metal salt solution onto a recording medium and then applying an ink composition containing a dye material having at least one carboxyl group (see, e.g., Japanese Patent Laid-Open No. 202328/1993). According to this method, polyvalent metal ions combine with the dye to form an insoluble composite which can provide an image having water resistance and high quality free from color bleeding.

Further, an ink jet recording method has been proposed wherein a color ink containing at least a surfactant or a penetrable solvent and a salt for imparting a penetrating property is used in combination with a black ink which cooperates with the salt to cause thickening or coagulation. This method provides a high-quality color image having high image density and free from color bleeding (Japanese Patent Laid-Open No. 106735/1994). More specifically, in this method, two liquids, i.e., a first liquid containing a salt and a second liquid of an ink composition, are printed to provide a good image.

Furthermore, other ink jet recording methods wherein two liquids are printed have been proposed, for example, in Japanese Patent Laid-Open No. 240557/1991 and No. 240558/1991.

SUMMARY OF THE INVENTION

The present inventors have now found that, in the above ink jet recording method wherein two liquids are printed, the deposition of a first liquid onto a recording medium through an intermediate transfer medium can provide a good image. The present invention has been made based on such finding.

Accordingly, an object of the present invention is to provide an ink jet recording method, capable of forming a good image, which comprises printing two liquids.

According to one aspect of the present invention, there is provided an ink jet recording method wherein a first liquid containing a reactant and an ink composition are deposited onto a recording medium, said method comprising the steps of:

depositing the first liquid onto an intermediate transfer medium;

transferring the first liquid deposited onto the intermediate transfer medium onto the recording medium; and ejecting droplets of the ink composition onto the recording medium to record an image.

DETAILED DESCRIPTION OF THE INVENTION

Ink Jet Recording Method and Apparatus

Figure 1:
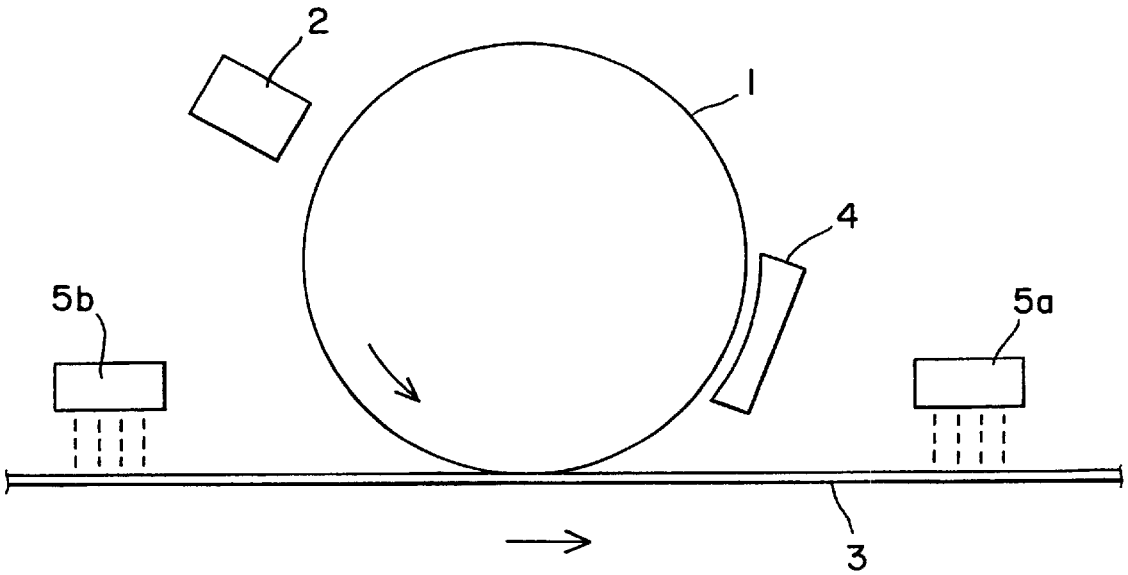
FIG. 1 is an ink jet recording apparatus for practicing the ink jet recording method according to the present invention, wherein a first liquid is once deposited onto the surface of an intermediate transfer drum 1 by means 2 for depositing a first liquid and the deposited first liquid is then transferred onto a recording medium 3.

The ink jet recording method according to the present invention includes the steps of: depositing the first liquid onto an intermediate transfer medium; and then transferring the first liquid, deposited onto the intermediate transfer medium, onto a recording medium. The ink jet recording method according to the present invention, as compared with an ink jet recording method wherein the first liquid is deposited directly onto the recording medium, can advantageously realize a good image using the first liquid in a smaller amount. The amount of the first liquid can be reduced to about one-half to one-tenth the amount of the ink composition used. Further, according to the ink jet recording method of the present invention, the first liquid can be thinly and evenly coated on the surface of the recording medium, enabling the creation of the cockle or curling of the recording medium to be prevented. Furthermore, uneven printing can be effectively prevented. In addition, in some cases, the content of the reactant, a precipitate of which has a fear of clogging of the nozzle, in the first liquid can be reduced. Furthermore, the surface tension of the first liquid can be enhanced. These advantageously enable the properties of the first liquid to be rendered suitable for the ejection by the ink jet recording method.

In the present invention, the first liquid may be deposited onto the intermediate transfer medium either by an ink jet recording system wherein droplets of the first liquid are formed and ejected onto the intermediate transfer medium or by coating the first liquid onto the intermediate transfer medium. In the former method, the first liquid is deposited onto only a limited area where the ink is deposited. Therefore, the printing can be efficiently conducted using the first liquid in a small amount. Further, the cockling and curling of the recording medium can be effectively prevented. However, the accuracy to a certain extent is required on the position where both the first liquid and the ink composition are deposited. On the other hand, in the latter method, the demand for the accuracy on the position of the first liquid and the ink composition can be relaxed as compared with the former method. In this case, however, the first liquid should be thinly and evenly deposited onto only the surface of the recording medium from the viewpoint of preventing the creation of cockling and curling of the recording medium.

In the recording method using two liquids such as an ink jet recording method according to the present invention, a good print can be realized by bringing the first liquid into contact with the ink composition. Upon contact of the first liquid with the ink composition, the reactant contained in the first liquid breaks the state of dispersion of the colorant and other ingredients in the ink composition, leading to agglomeration of the colorant and the other ingredients. The agglomerate is considered to deposit onto the recording medium, realizing a print having high color density and no significant bleeding or feathering and unevenness. Further, advantageously, in the case of a color image, uneven color-to-color intermixing in the region of boundary between different colors, that is, color bleeding, can be effectively prevented.

In the present invention, the first liquid is brought into contact with the ink composition. The step of ejecting droplets of the ink composition onto the recording medium to record an image may be performed after the first liquid deposited onto the intermediate transfer medium is transferred onto the recording medium, or alternatively, the step of ejecting droplets of the ink composition onto the recording medium to record an image may be performed before the first liquid deposited onto the intermediate transfer medium is transferred onto the recording medium.

A recording apparatus for practicing the ink jet recording method according to the present invention will be described.

The recording apparatus, according to the present invention, shown in FIG. 1 comprises an intermediate transfer drum 1 as an intermediate transfer medium and a first liquid-depositing means 2 for depositing the first liquid onto an intermediate transfer medium. The intermediate transfer drum 1 is rotated by means of drive means (not shown), and the surface thereof is constructed so that it comes into pressure contact with a recording medium 3.

According to a preferred embodiment of the present invention, the first liquid-depositing means 2 is an ink jet recording head which functions to form droplets of the first liquid and to eject and deposit them onto an intermediate transfer drum 1. The first liquid deposited onto the intermediate transfer drum 1 is moved upon rotation of the intermediate transfer drum 1 and, upon the pressure contact of the recording medium 3 with the intermediate transfer drum 1, is transferred onto the recording medium 3. In this embodiment, the position where an ink composition is printed by means of ink jet recording means described below is preferably identical to the position where the first liquid transferred from the intermediate transfer medium onto the recording medium 3.

According to a second preferred embodiment of the present invention, the first liquid depositing means 2 is means for coating the first liquid onto the surface of the intermediate transfer drum 1. Specifically, the deposition according to this embodiment may be carried out by bringing a water absorptive porous material, such as sponge, impregnated with the first liquid into pressure contact with the intermediate transfer drum 1, by evenly or unevenly depositing the first liquid onto the intermediate transfer drum 1 by means of spray means or the like, by dropping the first liquid onto the intermediate transfer drum 1 and then regulating the coating by means of a blade or the like, or by other methods. Rotation of the intermediate transfer drum 1 permits the first liquid deposited onto the intermediate transfer drum 1 to be moved, and, upon pressure contact of the recording medium 3 with the intermediate transfer medium 1, the first liquid is transferred onto the recording medium 3.

According to a preferred embodiment of the present invention, the surface of the intermediate transfer drum 1 has liquid-nonabsorptive properties from the viewpoint of enhancing the efficiency of transfer of the first liquid onto the recording medium. Therefore, preferred materials for the surface of the intermediate transfer drum 1 include water-insoluble resins, such as polyethylene, polypropylene, polystyrene, polyester, and polyvinyl chloride, metals, such as iron, nickel, silicon, aluminum, tin, and zinc or oxides of the above metals, and alloys, such as brass and stainless steel.

The surface of the intermediate transfer drum 1 after the completion of the transfer of the first liquid onto the recording medium 3 is cleaned with cleaning means 4.

When recording is performed using an ink composition after the deposition of the first liquid onto the recording medium 3, an ink jet recording head is provided on a position 5*a* in the drawing. On the other hand, when the ink composition is recording before the first liquid is deposited onto the recording medium 3, the ink jet recording head is provided on a position 5*b* in the drawing. The ink jet recording head may be the same as those commonly used in ink jet recording.

First Liquid

The first liquid used in the present invention comprises a reactant that functions to break the state of dispersion of a colorant and other ingredients in the ink composition and to agglomerate the colorant component and the other ingredients.

An example of the first liquid used in the present invention is a liquid containing as the reactant a polyvalent metal salt, a polyamine, a polyamine derivative, an acidic liquid, a cationic surfactant or the like.

When the reactant is a polyvalent metal salt, preferred examples thereof include those which are constituted by divalent or higher polyvalent metallic ions and anions bonded to the polyvalent metallic ions and are soluble in water. Specific examples of polyvalent metallic ions include divalent metallic ions, such as $Ca^{2+}$, $Cu^{2+}$, $Ni^{2+}$, $Mg^{2+}$, $Zn^{2+}$, and $Ba^{2+}$, trivalent metallic ions, such as $Al^{3+}$, $Fe^{3+}$, and $Cr^{3+}$. Anions include $Cl^-$, $NO_3^-$, $I^-$, $Br^-$, $ClO_3^-$, and $CH_3COO^-$.

In particular, a metal salt constituted by $Ca^{2+}$ or $Mg^{2+}$ provides favorable results in terms of pH of the first liquid and the quality of prints.

The concentration of the polyvalent metal salt in the first liquid may be suitably determined so as to attain the effect of providing a good print quality and preventing clogging. It, however, is preferably about 0.1 to 40% by weight, more preferably about 5 to 25% by weight.

According to a preferred embodiment of the present invention, the polyvalent metal salt contained in the first liquid comprises a divalent or higher polyvalent metallic ions and nitrate ions or carboxylate ions bonded to these polyvalent metal ions and is soluble in water.

In the present invention, carboxylate ions are preferably those derived from a saturated aliphatic monocarboxylic acid having 1 to 6 carbon atoms or a carbocyclic monocarboxylic acid having 7 to 11 carbon atoms. Examples of preferred saturated aliphatic monocarboxylic acids having 1 to 6 carbon atoms include formic acid, acetic acid, propionic acid, butyric acid, isobutyric acid, valeric acid, isovaleric acid, pivalic acid, and hexanoic acid. Among them, formic acid and acetic acid are particularly preferred.

A hydrogen atom(s) on the saturated aliphatic hydrocarbon residue in the monocarboxylic acid may be substituted by a hydroxyl group. Examples of preferred carboxylic acids usable herein include lactic acid.

Examples of preferred carbocyclic monocarboxylic acids having 6 to 10 carbon atoms include benzoic acid and naphthoic acid with benzoic acid being more preferred.

The polyallylamine and polyallylamine derivative usable as the reactant are cationic polymers which are soluble in water and can be positively charged in water. Examples thereof include, for example, those represented by the following formulae (a) to (c):

(a)

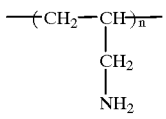

(b)

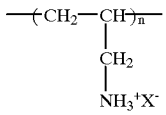

(c)

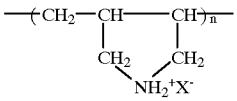

wherein $X^{31}$ represents chloride, bromide, iodide, nitrate, phosphate, sulfate, acetate or other ion.

In addition, a copolymer of an allylamine with a diallylamine and a copolymer of diallylmethylammonium chloride with sulfur dioxide may also be used.

The content of the polyallylamine and the polyallylamine derivative is preferably 0.5 to 10% by weight based on the first liquid.

According to a preferred embodiment of the present invention, the first liquid may contain a wetting agent comprising a high-boiling organic solvent. The high-boiling organic solvent serves to prevent the first liquid from being concentrated due to evaporation, thus preventing clogging of a recording head. Examples of preferred high-boiling organic solvents, some of which are those described above in connection with the polyol, include polyhydric alcohols such as ethylene glycol, diethylene glycol, triethylene glycol, polyethylene glycol, polypropylene glycol, propylene glycol, butylene glycol, 1,2,6-hexanetriol, thioglycol, hexylene glycol, glycerin, trimethylolethane, and trimethylolpropane; alkyl ethers of polyhydric alcohols, such as ethylene glycol monoethyl ether, ethylene glycol monobutyl ether, diethylene glycol monomethyl ether, diethylene glycol monoethyl ether, diethylene glycol monobutyl ether, triethylene glycol monomethyl ether, and triethylene glycol monoethyl ether, and triethylene glycol monobutyl ether; urea, 2-pyrrolidone, N-methyl-2-pyrrolidone, 1,3-dimethyl-2-imidazolidinone, and triethanolamine.

Although the amount of the high-boiling organic solvent added is not particularly limited, it is preferably about 0.5 to 40% by weight, more preferably about 2 to 20% by weight.

According to a preferred embodiment of the present invention, the first liquid may contain a low-boiling organic solvent. Examples of preferred low-boiling organic solvents usable herein include methanol, ethanol, n-propyl alcohol, iso-propyl alcohol, n-butanol, sec-butanol, tert-butanol, iso-butanol, and n-pentanol. Monohydric alcohols are particularly preferred. The low-boiling organic solvent has the effect of shortening the time taken for drying the ink. The amount of the low-boiling organic solvent added is preferably in the range of from 0.5 to 10% by weight, more preferably in the range of from 1.5 to 6% by weight.

According to a preferred embodiment of the present invention, the first liquid may contain a penetrant, and examples of penetrants usable herein include: various surfactants such as anionic, cationic, and amphoteric surfactants; alcohols such as methanol, ethanol, and iso-propyl alcohol; and lower alkyl ethers of polyhydric alcohols, such as ethylene glycol monomethyl ether, diethylene glycol monoethyl ether, diethylene glycol monobutyl ether, triethylene glycol monobutyl ether, propylene glycol monobutyl ether, and dipropylene glycol monobutyl ether.

A colorant, which will be described in the paragraph of "Ink composition" below, may be added to color the first liquid so that the first liquid serves also as the ink composition.

Ink Composition

The term "ink composition" used herein refers to a black ink composition when the ink composition is used for monochrome printing; and a color ink composition, when color printing is performed, specifically a yellow ink composition, a magenta ink composition, and a cyan ink composition, and, in some cases, a black ink composition.

The ink composition used in the present invention comprises at least a colorant and water.

The colorant contained in the ink composition used in the present invention may be either a dye or a pigment, and, when the penetration of the colorant component in the ink is suppressed by insolubilization, thickening or other effects of the ink composition, use of a pigment dispersed in an aqueous medium rather than a dye dissolved in an aqueous medium is advantageous.

Dyes usable herein include various dyes commonly used in ink jet recording, such as direct dyes, acid dyes, foodstuff dyes, basic dyes, reactive dyes, disperse dyes, vat dyes, soluble vat dyes, and reactive disperse dyes.

Regarding the pigment, inorganic and organic pigments are usable without any particular limitation. Examples of the inorganic pigment include, in addition to titanium oxide and iron oxide, carbon blacks produced by known processes, such as contact, furnace, and thermal processes. Examples of the organic pigment include azo pigments (including azo lake, insoluble azo pigment, condensed azo pigment, and chelate azo pigment), polycyclic pigments (for example, phthalocyanine, perylene, perinone, anthraquinone, quinacridone, dioxazine, thioindigo, isoindolinone, and quinophthalone pigments), dye chelates (for example, basic dye chelates and acid dye chelates), nitro pigments, nitroso pigments, and aniline black.

According to a preferred embodiment of the present invention, the above pigment is preferably added, to the ink, in the form of a pigment dispersion prepared by dispersing the pigment in an aqueous medium with the aid of a dispersant or a surfactant. Preferred dispersants include those commonly used in the preparation of a dispersion of a pigment, for example, polymeric dispersant.

Preferred examples of dispersants or surfactants usable herein include polyacrylic acid, polymethacrylic acid, acrylic acid/acrylonitrile copolymer, vinyl acetate/acrylic ester copolymer, acrylic acid/alkyl acrylate copolymer, styrene/acrylic acid copolymer, styrene/methacrylic acid copolymer, styrene/acrylic acid/alkyl acrylate copolymer, styrene/methacrylic acid/alkyl acrylate copolymer, styrene/α-methylstyrene/acrylic acid copolymer, styrene/α-methylstyrene/acrylic acid/alkyl acrylate copolymer, styrene/maleic acid copolymer, vinylnaphthalene/maleic acid copolymer, vinyl acetate/ethylene copolymer, vinyl acetate/fatty acid/vinyletheylene copolymer, vinyl acetate/maleic ester copolymer, vinyl acetate/crotonic acid copolymer, and vinyl acetate/acrylic acid copolymer.

According to a preferred embodiment of the present invention, the weight average molecular weight of these copolymers is preferably about 3,000 to 50,000, more preferably about 5,000 to 30,000, most preferably about 7,000 to 15,000.

The amount of the dispersant added may be properly determined so that other effects of the present invention are not deteriorated. According to a preferred embodiment of the present invention, the amount of the dispersant used in terms of pigment:dispersant is preferably about 1:0.06 to 1:3, more preferably about 1:0.125 to 1:3.

As will be apparent to those skilled in the art, the dispersant and the surfactant contained in the pigment dispersion would serve also as a dispersant and a surfactant for the ink composition.

The amount of the pigment added to the ink is preferably about 0.5 to 25% by weight, more preferably about 2 to 15% by weight.

The ink composition used in the present invention may contain a dispersant or a surfactant. Examples of dispersants or surfactants usable herein include various surfactants described above in connection with the resin emulsion.

According to a preferred embodiment of the present invention, the ink composition comprises a resin emulsion. The term "resin emulsion" used herein refers to an emulsion comprising water as a continuous phase and the following resin component as a dispersed phase. Resin components as the dispersed phase include acrylic resin, vinyl acetate resin, styrene/butadiene resin, vinyl chloride resin, (meth)acrylate/styrene resin, butadiene resin, styrene resin, crosslinked acrylic resin, crosslinked styrene resin, benzoguanamine resin, phenolic resin, silicone resin, and epoxy resin.

According to a preferred embodiment of the present invention, the resin is a polymer having a combination of a hydrophilic segment with a hydrophobic segment. The particle diameter of the resin component is not particularly limited so far as the resin component can form an emulsion. It, however, is preferably not more than about 150 nm, more preferably about 5 to 100 nm.

The resin emulsion may be prepared by dispersion polymerization of a resin monomer, optionally together with a surfactant, in water. For example, an emulsion of an acrylic resin or a styrene/acrylic resin may be prepared by subjecting an ester of (meth)acrylic acid or alternatively an ester of (meth)acrylic acid in combination with styrene to dispersion polymerization in water in the presence of a surfactant. In general, the mixing ratio of the resin component to the surfactant is preferably about 10:1 to 5:1. When the amount of the surfactant used falls within the above range, it is possible to provide an ink which has good water resistance in the form of an image and good penetrability. The surfactant is not particularly limited. Preferred examples thereof include anionic surfactants (for example, sodium dodecylbenzenesulfonate, sodium laurate and an ammonium salt of a polyoxyethylene alkyl ether sulfate); nonionic surfactants (for example, a polyoxyethylene alkyl ether, a polyoxyethylene alkyl ester, a polyoxyethylene sorbitan fatty acid ester, a polyoxyethylene alkyl phenyl ether, a polyoxyethylene alkylamine, and a polyoxyethylene alkylamide). They may be used alone or as a mixture of two or more. Further, it is also possible to use acetylene glycol (OLFINE Y and Surfynol 82, 104, 440, 465, and 485 (all the above products being manufactured by Air Products and Chemicals Inc.).

The ratio of the resin as the component constituting the dispersed phase to water is suitably 60 to 400 parts by weight based on 100 parts by weight of the resin with 100 to 200 parts by weight, based on 100 parts by weight of the resin, of water being preferred.

Further, commercially available resin emulsions may also be used, and examples thereof include Microgel E-1002 and E-5002 (styrene/acrylic resin emulsion, manufactured by Nippon Paint Co., Ltd.), Voncoat 4001 (acrylic resin emulsion, manufactured by Dainippon Ink and Chemicals, Inc.), Voncoat 5454 (styrene/acrylic resin emulsion, manufactured by Dainippon Ink and Chemicals, Inc.), SAE-1014 (styrene/acrylic resin emulsion, manufactured by Nippon Zeon Co., Ltd.), and Saivinol SK-200 (acrylic resin emulsion, manufactured by Saiden Chemical Industry Co., Ltd).

In the ink used in the present invention, the amount of the resin emulsion incorporated therein is preferably such that the amount of the resin component is in the range of from 0.1 to 40% by weight, more preferably in the range of from 1 to 25% by weight.

The resin emulsion has the effect of inhibiting the penetration of a coloring component and, further, accelerating the fixation on the recording medium by virtue of an interaction between the resin emulsion and the polyvalent metal ions. Further, some resin emulsions have an additional effect that they form a film on the recording medium to improve the rubbing resistance of the resultant print.

According to a preferred embodiment of the present invention, the ink composition contains a thermoplastic resin in the form of a resin emulsion. In this case, the thermoplastic resin has a softening temperature of 50 to 250° C., preferably 60 to 200° C. The term "softening temperature" used herein refers to the lowest temperature among the glass transition temperature of the thermoplastic resin, the melting point of the thermoplastic resin, the temperature which brings the viscosity of the thermoplastic resin to $10^{11}$ to $10^{12}$ poises, the pour point of the thermoplastic resin, and the minimum film forming temperature (MFT) in the form of an emulsion of the thermoplastic resin. When an ink composition comprising the above resin emulsion is used, the step of heating the recording medium, after recording, at a temperature of the softening temperature of the thermoplastic resin or above is preferably carried out.

Further, preferably, the thermoplastic resin, when heated at the softening or melting temperature or a higher temperature and then cooled, forms a strong film having water resistance and rubbing resistance.

Specific examples of water-insoluble thermoplastic resins include, but are not limited to, polyacrylic acid, polymethacrylic acid, an ester of polymethacrylic acid, polyethylacrylic acid, a styrene/butadiene copolymer, polybutadiene, an acrylonitrile/butadiene copolymer, a chloroprene copolymer, a fluororesin, polyvinylidene fluoride, polyolefin resin, cellulose, a styrene/acrylic acid copolymer, a styrene/methacrylic acid copolymer, polystyrene, a styrene/acrylamide copolymer, polyisobutyl acrylate, polyacrylonitrile, polyvinyl acetate, polyvinyl acetal, polyamide, rosin resin, polyethylene, a polycarbonate, a polyvinylidene chloride resin, a cellulosic resin, a vinyl acetate resin, an ethylene/vinyl acetate copolymer, a vinyl acetate/(meth)acrylate copolymer, a vinyl chloride resin, polyurethane, and a rosin ester.

Specific examples of low-molecular weight thermoplastic resins include polyethylene wax, montan wax, alcohol wax, synthetic oxide wax, an $\alpha$-olefin/maleic anhydride copolymer, animal and vegetable waxes, such as carnauba wax, lanolin, paraffin wax, and microcrystalline wax.

Conventional resin emulsions may also be used as the above emulsion, and resin emulsions described, for example, in Japanese Patent Publication No. 1426/1987 and Japanese Patent Laid-Open Nos. 56573/1991, 79678/1991, 160068/1991, and 18462/1992 as such may be used in the present invention.

According to a preferred embodiment of the present invention, the ink composition comprises an alginic acid derivative, and examples of preferred alginic acid derivatives include alkali metal salts of alginic acid (for example, sodium salt or potassium salt), organic salts (for example, triethanol amine salt) of alginic acid, and ammonium alginate.

The amount of the alginic acid derivative added to the ink composition is preferably about 0.01 to 1% by weight, more preferably about 0.05 to 0.5% by weight.

Although the reason why addition of the alginic acid derivative results in the formation of a good image has not been elucidated yet, it is believed that the reactant present in the first liquid, particularly a polyvalent metal salt, reacts with the alginic acid derivative in the ink composition to cause a change in dispersed state of the colorant, accelerating the fixation of the colorant onto the recording medium.

The ink composition to be used in the present invention may optionally contain an inorganic oxide colloid. Preferred examples of inorganic oxide colloids usable herein include colloidal silica and alumina colloid. These are generally a colloidal solution of ultrafine particles of $SiO_2$ or $Al_2O_3$ dispersed in water or an organic solvent. Commercially available inorganic oxide colloids are generally such that the dispersion medium is water, methanol, 2-propanol, n-propanol, xylene or the like and the diameter of $SiO_2$, $Al_2O_3$ and other particles is 5 to 100 nm. Further, pH of the colloidal solutions of inorganic oxide is, in many cases, adjusted to the acidic or alkaline side rather than the neutral region. This is because the stable dispersion region of the inorganic oxide colloid is present on the acidic side or the alkaline side. In adding the colloidal solution to the ink composition, pH of the stable dispersion region of the inorganic oxide colloid and pH of the ink should be taken into consideration.

The amount of the inorganic oxide colloid added to the ink composition is preferably 0.1 to 15% by weight, and addition of two or more inorganic oxide colloids is also possible.

According to a preferred embodiment of the present invention, the ink composition preferably contains an organic solvent. The organic solvent is preferably a low-boiling organic solvent, and preferred examples thereof include methanol, ethanol, n-propyl alcohol, iso-propyl alcohol, n-butanol, sec-butanol, tert-butanol, iso-butanol, and n-pentanol. Monohydric alcohols are particularly preferred. The low-boiling organic solvent has the effect of shortening the time taken for drying the ink.

Further, according to a preferred embodiment of the present invention, the ink composition used in the present invention further comprises a wetting agent comprising a high-boiling organic solvent. Preferred examples of high-boiling organic solvents usable herein include polyhydric alcohols such as ethylene glycol, diethylene glycol, triethylene glycol, polyethylene glycol, polypropylene glycol, propylene glycol, butylene glycol, 1,2,6-hexanetriol, thioglycol, hexylene glycol, glycerin, trimethylolethane, and trimethylolpropane; alkyl ethers of polyhydric alcohols, such as ethylene glycol monoethyl ether, ethylene glycol monobutyl ether, diethylene glycol monomethyl ether, diethylene glycol monoethyl ether, diethylene glycol monobutyl ether, triethylene glycol monomethyl ether, triethylene glycol monoethyl ether, and triethylene glycol monobutyl ether; urea; 2-pyrrolidone; N-methyl-2-pyrrolidone; 1,3-dimethyl-2-imidazolidinone; and triethanolamine.

The amount of the wetting agent added is preferably in the range of from 0.5 to 40% by weight, more preferably in the range of from 2 to 20% by weight, based on the ink. The amount of the low-boiling organic solvent added is preferably 0.5 to 10% by weight, more preferably in the range of from 1.5 to 6% by weight, based on the ink.

According to a preferred embodiment of the present invention, the ink composition contains a saccharide. Examples of saccharides usable herein include monosaccharides, disaccharides, oligosaccharides (including trisaccharides and tetrasaccharides), and other polysaccharides, preferably glucose, mannose, fructose, ribose, xylose, arabinose, galactose, aldonic acid, glucitol, sorbitol, maltose, cellobiose, lactose, sucrose, trehalose, and maltotriose. The term "polysaccharide" used herein refers to saccharides, in a broad sense, including substances which widely exist in the natural world, such as alginic acid, α-cyclodextrin, and cellulose.

Derivatives of these saccharides include reducing sugars of the above saccharides (for example, sugar alcohols represented by the general formula $HOCH_2(CHOH)_nCH_2OH$ wherein n is an integer of 2 to 5), oxidized sugars (for example, aldonic acid and uronic acid), amino acid, and thiosugars. Sugar alcohols are particularly preferred, and specific examples thereof include maltitol and sorbitol.

The content of the above saccharide is suitably in the range of from 0.1 to 40% by weight, preferably 0.5 to 30% by weight, based on the ink.

Further, if necessary, pH adjustors, preservatives, antimolds and the like may be added.

EXAMPLES

Although the present invention will be described in more detail with reference to the following examples, they are not limited to these examples only.

First Liquid

| | |
|---|---|
| Magnesium nitrate hexahydrate | 25 wt % |
| Triethylene glycol monobutyl ether | 5 wt % |
| Glycerin | 20 wt % |
| Ion-exchanged water | Balance |

The ingredients were mixed together to prepare a first liquid.

Black Ink

| | |
|---|---|
| Carbon black MA7 (manufactured by Mitsubishi Kasei Corp.) | 5 wt % |
| Styrene/acrylic acid copolymer ammonium salt (molecular weight 7000, resin component 38%; dispersant) | 3 wt % |
| Grandoll PP-1000 (styrene/acrylic resin emulsion, resin component 45%, manufactured by Dainippon Ink and Chemicals, Inc.) | 7 wt % |
| Maltitol | 7 wt % |
| Glycerin | 10 wt % |
| 2-Pyrrolidone | 2 wt % |
| Ion-exchanged water | Balance |

The carbon black and the dispersant were mixed together, and the mixture, together with glass beads (diameter: 1.7 mm, amount: 1.5 times (by weight) larger than the mixture), was dispersed for 2 hr in a sand mill (manufactured by Yasukawa Seisakusho). Thereafter, the glass beads were removed, other additives were added, and the mixture was stirred at room temperature for 20 min. The mixture was filtered through a 5 μm membrane filter to prepare an ink jet recording ink.

Color Ink

A cyan ink composition, a magenta ink composition, and a yellow ink composition were prepared using the following colorants and liquid media according to the above method for preparing the black ink.

| | |
|---|---|
| Cyan ink | |
| Copper phthalocyanine magenta ink | 2 wt % |
| C.I. Pigment Red 122 | 3 wt % |
| Yellow ink | |
| C.I. Pigment Yellow 17 | 2 wt % |

Liquid Medium

| | |
|---|---|
| Styrene/acrylic acid copolymer ammonium salt (molecular weight 7000, resin component 38%: dispersant) | 1.5 wt % |
| Voncoat 5454 (styrene/acrylic resin emulsion, resin component 45%, manufactured by Dainippon Ink and Chemicals, Inc.) | 5 wt % |
| Sucrose | 10 wt % |
| Glycerin | 10 wt % |
| Ion-exchanged water | Balance |

Printing

Printing was basically performed as follows. The first liquid was coated at a density of 360 dpi onto a PET film and an ejection rate of 0.02 μg/dot by means of an ink jet head used in a printer MJ-700V2C (manufactured by Seiko Epson Corporation). This PET film was then brought into pressure contact with a recording paper to transfer the reaction liquid onto the recording paper. Thereafter, the black ink and the color ink were printed on the recording paper with the first liquid transferred thereon by means of a head used in the printer MJ-700V2C at a density of 360 dpi and an ejection rate of 0.06 μg/dot.

In Comparative Examples 1 and 2, the first liquid was deposited directly on the recording medium by means of the same ink jet head, as used above, at an ejection rate of 0.02 μg/dot or 0.06 μg/dot, and printing was then performed on the recording medium in the same manner as described above.

PRINT EVALUATION TEST

Evaluation 1: Circularity

Printing was performed on two recording papers, Xerox 4024 3R 721 (Xerox Corp) and Xerox R (recycled paper). In the printing, the first liquid was deposited onto a recording medium (100% duty), and dots were printed using the ink composition.

The circularity of the dots thus formed was defined as $4\pi S/L^2$, wherein S represents the area of the dot and L represents the perimeter of the dot, and was evaluated according to the following criteria:

A: Circularity of not more than 1 to 0.9 for both papers

B: Circularity of 0.9 to 0.8 for any one of or both papers

Evaluation 2: Print Quality (feathering)

Xerox P paper (Xerox Corp.) was provided as recording paper, the first liquid was first deposited (100% duty) on the recording paper, and letters were then printed using the black ink. After drying, the letters were inspected for feathering. The results were evaluated as follows.

A: Sharp print free from feathering

B: Feathering created

NG: Remarkable feathering to render the outline of the letter blurry

Evaluation 3: Color Bleeding

The first liquid was first deposited (100% duty) on the following various papers, and color inks (cyan, magenta, and yellow) (100% duty) and the black ink (a letter) were simultaneously printed to examine the prints for the presence of uneven color-to-color mixing in the letter boundaries.

(1) Xerox P Paper (Xerox Corp.)

(2) Ricopy 6200 Paper (Ricoh Co. Ltd.)

(3) Xerox 4024 Paper (Xerox Corp.)

(4) Neenah Bond Paper (Kimberly-Clark)

(5) Xerox R Paper (Xerox Corp., recycled paper)

(6) Yamayuri (Honshu Paper Co., Ltd., recycled paper)

The results were evaluated as follows.

A: No color-to-color mixing observed with clear letter boundaries

B: Feather-like color-to-color mixing observed

NG: Significant color-to-color mixing observed rendering the outline of the letter blurry Evaluation 4: Print Quality (OD)

The first liquid was first printed (100% duty) on the papers used in the evaluation 2, and letters were then printed using the black ink. After drying, the reflection optical density (OD) of the prints was measured with Macbeth PCMII (manufactured by Macbeth).

Evaluation 5: Paper Cockling

Xerox P paper was provided as the recording paper. A single color ink of cyan 100 duty and a red, a mixed color of 100% magenta and 100% cyan, each were printed in a size of 3 cm×3 cm.

A: No paper cockling was created even in mixed color.

B: Paper cockling was created in mixed color although it was not created in single color.

C: Paper cockling was created in both mixed color and single color.

The results of evaluation are summarized in the following table.

TABLE 1

| | Amount of first liquid coated, μg/dot | Coating method for first liquid | Evaluation 1: circularity | Evaluation 2: feathering | Evaluation 3: color bleeding | Evaluation 4: OD | Evaluation 5: paper cockling |
|---|---|---|---|---|---|---|---|
| Example | 0.02 | Transfer | A | A | A | 1.51 | A |
| Comparative Example 1 | 0.02 | Direct | A | A | A | 1.44 | B |
| Comparative Example 2 | 0.06 | Direct | B | A | A | 1.44 | C |

What is claimed is:

1. An ink jet recording method comprising the steps of:

providing a first liquid containing a reactant and an ink composition comprising a colorant and a plurality of other ingredients said colorant and plurality of other ingredients being present in the ink composition in a state of dispersion, said reactant being one that breaks the state of dispersion and causes formation of an agglomerate when the first liquid and the ink composition come into contact with each other;

depositing the first liquid onto an intermediate transfer medium;

transferring the first liquid deposited onto the intermediate transfer medium onto the recording medium; and ejecting droplets of the ink composition onto the recording medium to record an image and to cause contact between the first liquid and the ink composition whereby to form said agglomerate on said recording medium.

2. The method according to claim 1, wherein the deposition of the first liquid onto the intermediate transfer medium is performed by an ink jet recording system wherein droplets of the first liquid are formed, ejected, and deposited onto the intermediate transfer medium.

3. The method according to claim 1, wherein the deposition of the first liquid onto the intermediate transfer medium is performed by coating the first liquid onto the intermediate transfer medium.

4. The method according to claim 1, wherein the step of ejecting droplets of the ink composition onto the recording medium to record an image is performed after the first liquid deposited onto the intermediate transfer medium is transferred onto the recording medium.

5. The method according to claim 1, wherein the step of ejecting droplets of the ink composition onto the recording medium to record an image is performed before the first liquid deposited onto the intermediate transfer medium is transferred onto the recording medium.

6. The method according to claim 1, wherein the reactant is a polyvalent metal salt and/or a polyallylamine.

7. The method according to claim 6, wherein the polyvalent metal salt is a salt of nitric acid or a salt of a carboxylic acid.

8. The method according to claim 1, wherein the ink composition comprises a colorant and a resin emulsion.

9. The method according to claim 8, wherein the ink composition contains a pigment as a colorant.

10. A recorded medium recorded by the ink jet recording method according to claim 1.

11. An ink jet recording apparatus for conducting printing using a first liquid containing a reactant and an ink composition onto a recording medium, said ink jet recording apparatus comprising:

an intermediate transfer medium;

means for depositing the first liquid onto the intermediate transfer medium;

transfer means for transferring the first liquid deposited onto the intermediate transfer medium onto the recording medium; and ink jet recording means for ejecting and depositing ink droplets of the ink composition onto the recording medium with the first liquid transferred thereon, thereby forming an image.

* * * * *